United States Patent [19]

Schmitz

[11] 4,415,010

[45] Nov. 15, 1983

[54] RETRACTOR APPARATUS FOR A WEFT-INSERTING PROJECTILE IN A WEAVING MACHINE

[75] Inventor: Gerd Schmitz, Sulz, Switzerland

[73] Assignee: Sulzer Brothers Limited, Winterthur, Switzerland

[21] Appl. No.: 313,175

[22] Filed: Oct. 20, 1981

[30] Foreign Application Priority Data

Oct. 24, 1980 [CH] Switzerland ..... 7930/80

[51] Int. Cl.[3] ..... D03D 47/24

[52] U.S. Cl. ..... 139/439

[58] Field of Search ..... 139/437, 438, 439, 155, 139/183, 185, 252

[56] References Cited

U.S. PATENT DOCUMENTS 2,207,107 7/1940 Payne ..... 139/185

2,538,798 1/1951 Pfarrwaller ..... 139/439

2,589,429 3/1952 Pfarrwaller ..... 139/439

3,875,974 4/1975 Rambousek ..... 139/155

*Primary Examiner*—Henry Jaudon

*Attorney, Agent, or Firm*—Kenyon & Kenyon

[57] ABSTRACT

The projectile weaving machine is provided with a retractor apparatus at the braking device in which an elastically yielding and damping body is disposed to absorb impact forces and damp vibrations. The elastically yielding and damping body is located between the stop surface of the retractor and a fulcrum between the retractor and a lever for moving the retractor within the apparatus. In some embodiments, the body is positioned between two parts of the retractor while in other embodiments, the body may be disposed between the retractor and the moving means or may be incorporated in the retractor itself.

9 Claims, 6 Drawing Figures

RETRACTOR APPARATUS FOR A WEFT-INSERTING PROJECTILE IN A WEAVING MACHINE

This invention relates to a retractor apparatus for a weft-inserting projectile in a weaving machine.

As is known, weaving machines which utilize projectiles of the gripper type for inserting a weft yarn in a shed of warp yarns usually employ a braking device to brake the projectile to a halt after insertion of a weft. In addition, these machines usually employ a retractor apparatus for re-positioning the projectile in a set position so that the projectile can be released from the inserted weft yarn and so that the projectile can be positioned for return to the picking side of the weaving machine, for example via an ejector channel.

However, in some cases, the projectiles may strike the retractor, for example due to wear of the brake linings of the brake device, so that not only is the projectile point damaged but also the retractor as well. As a result, impact notches may be formed on the forward end of the projectile which may lead to warp yarn damage. Of note, these impact notches may also damage the brake linings of the brake device during retraction since the brake device must still exert a slight clamping effect on the projectile in order to insure an exact positioning of the projectile in an opening or ejection position.

The projectiles may also impact against a retractor due to a varying lubrication of the projectile or a weft yarn break, particularly when the projectile arrives in the brake device with increased speed.

Any impact of the projectiles on the retractor may also produce undesired vibrations which can lead to irregularities in a cloth being produced, and particularly where fine monofilament yarns are used.

Accordingly, it is an object of the invention to improve the projectile retractor of a weaving machine which is operated at high speed in order to avoid damage to the projectiles should impacts on a retractor occur.

It is another object of the invention to provide a retractor apparatus for a weaving machine which is able to absorb impacts from a projectile in an elastically yielding manner.

It is another object of the invention to provide a retractor apparatus of relatively simple construction and which is elastically yieldable.

Briefly, the invention provides a retractor apparatus for a weft-inserting projectile in a weaving machine. The retractor apparatus is comprised of a retractor including a stop surface for abutting a weft-inserting projectile, means for moving the retractor from a rear position to a forward position in order to position an abutted projectile in a predetermined position and at least one elastically yielding and damping body between the stop surface and the moving means. The elastically yielding and damping body is such as to have a degree of elasticity which is sufficient for absorbing impact forces imposed on the stop surface with the retractor in the rear position. For example, the body has a degree of elasticity at least three times that of structural steel.

The use of the elastically yielding and damping body allows even an extremely high impact energy of a projectile to be absorbed without the projectile or the retractor being damaged and without the retractor being set into harmful vibrations.

In one embodiment, the retractor is made of two parts. One part functions as a stop part with the stop surface thereon while the second part functions as a holding part to which the stop part is connected in coaxial relation. In this embodiment, the elastically yielding and damping body is connected between the two parts in order to permit coaxial movement between the two parts, i.e. in the direction of motion. This construction allows the best material in terms of wear resistance to be selected, particularly for the stop part of the retractor.

The elastically and damping body may be made of annular shape or of channel shape with the parts of the retractor made of corresponding shape. In the case of the annular shape, a particularly stable fastening of the elastic body can be obtained.

In another embodiment, the means for moving the retractor may utilize a lever which is connected to the retractor via a bolt. In this case, the elastic body is in the form of a bushing which is disposed between the bolt and the retractor transverse to the direction of motion. This embodiment has the advantage that the retractor itself only has to be slightly modified.

In still another embodiment, the retractor has at least one transverse slit in which the elastic body is received. This is of particular advantage since the elastic body can be disposed adjacent to the stop surface, i.e. impact point, of the retractor.

In still another embodiment, the retractor may be constructed with a stop part having the stop surface thereon and a holding part which itself forms the elastic body. In this case, a particularly expedient combination of metal and plastic or of metals of different elasticity and damping properties can be used.

These and other objects and advantages of the invention will become more apparent from the following detailed description taken in conjunction with the accompanying drawings in which.

Figure 2A:
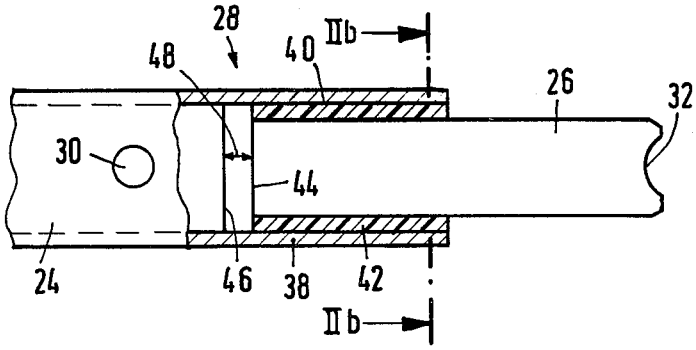
FIG. 2 illustrates an enlarged view of a retractor constructed in accordance with the invention and utilized in the brake device of FIG. 1.
Figure 2B:
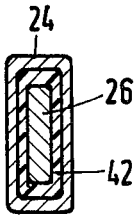

FIG. 2*b* illustrates a view taken on line IIb—IIb of FIG. 2*a;*

Figure 3A:
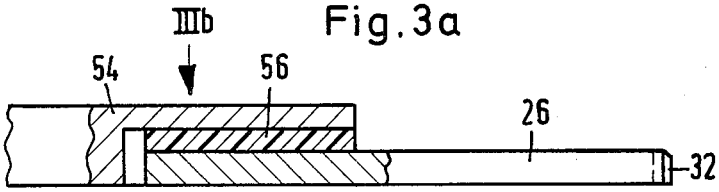
Figure 3C:
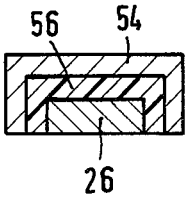
Figure 3B:
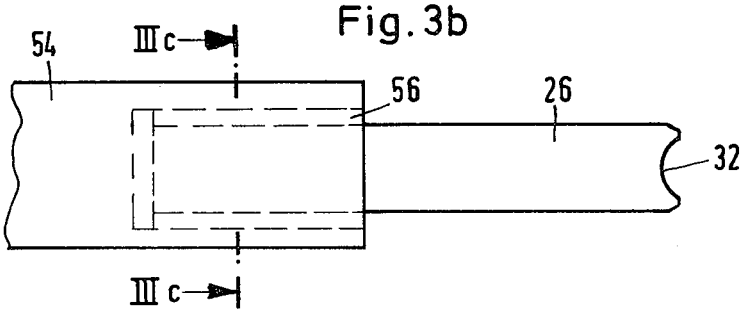

FIG. 3*a* illustrates a top view of a part of a retractor constructed in accordance with the invention;

FIG. 3*b* illustrates a view of the retractor of FIG. 3*a* taken in the direction of the arrow IIIb of FIG. 3*a;*

FIG. 3*c* illustrates a view taken on line IIIc—IIIc of FIG. 3*b;*

Figure 4:
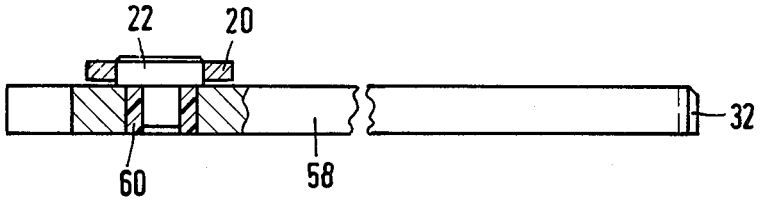
Figure 5:
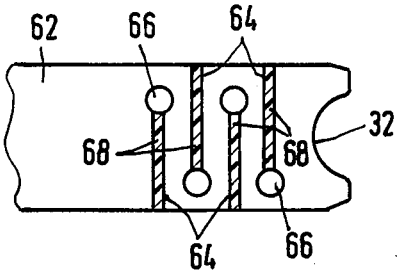
Figure 6A:
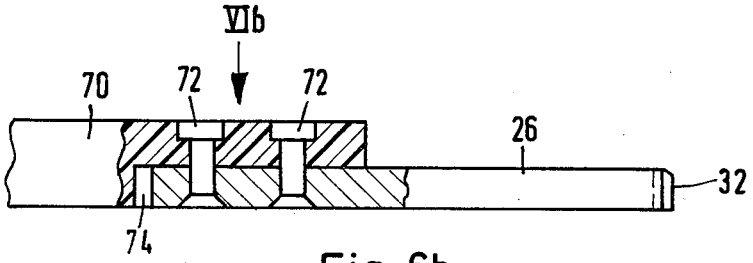
Figure 6B:
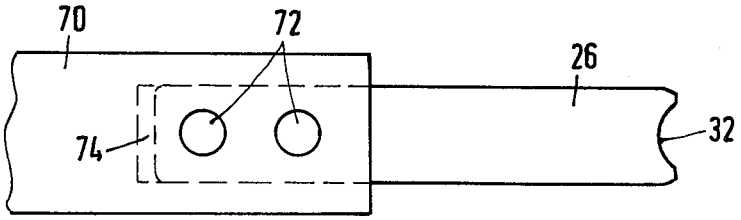

FIG. 4 illustrates a top view of a further embodiment of a retractor apparatus according to the invention;

FIG. 5 illustrates a still further embodiment of a retractor constructed in accordance with the invention;

FIG. 6*a* illustrates a top view of a two part retractor constructed in accordance with the invention; and FIG. 6*b* illustrates a view taken in the direction of arrow XIb of FIG. 6*a*.

Figure 1:
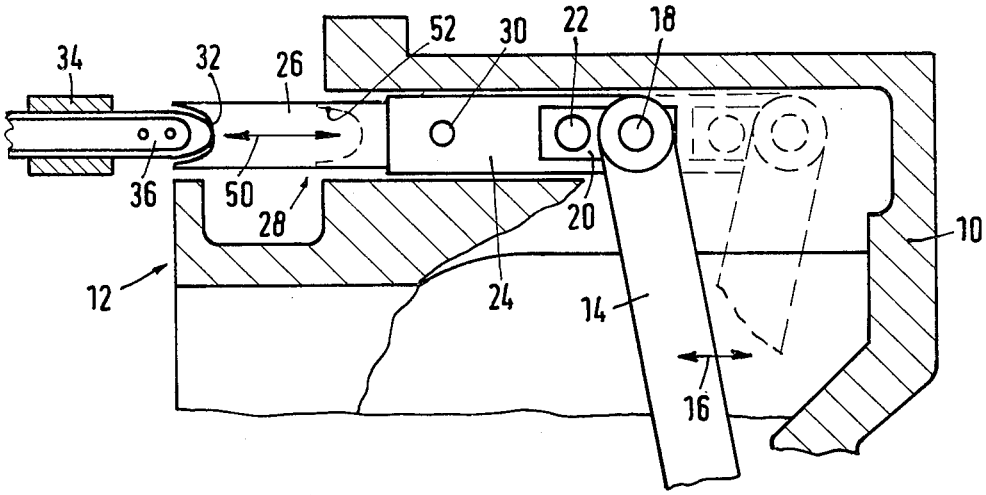
FIG. 1 illustrates a schematic representation of a brake device of a weaving machine employing projectiles for inserting weft yarns.

Referring to FIG. 1, the brake device 12, for example for a weaving machine in which weft yarns are inserted via gripper projectiles 36 has a housing 10 for housing a retractor apparatus. The retractor apparatus includes a retractor 28 and means for moving the retractor 28 from a rear position (shown in dotted line) to a forward position (shown in solid line) in order to position an abutted projectile 36 in a predetermined position, for example for release of a weft yarn and for return of the projectile 36, for example via an ejection channel (not shown), to the picking side of the weaving machine.

As indicated, the means for moving the retractor 28 includes a retractor lever 14 which is reciprocated back and forth in the direction indicated by the arrow 16 by conventional means (not shown). In addition, the means includes a pin 18 at one end of the lever 14, a shackle 20 which is pivoted about the pin 18 and a bolt 22 which secures the retractor 28 to the shackle 20 for movement with the lever.

Referring to FIG. *2a*, the retractor 28 is constructed of a stop part 26 having a stop surface 32 at one end and a holding part 24 which is connected in coaxial relation to the stop part 26. In addition, an elastically yielding and damping body 42 is connected between the holding part 24 and the stop part 26 in order to permit coaxial movement between the parts, i.e. in the direction of motion.

As indicated in FIGS. *2a* and *2b*, the holding part 24 is formed at the stop end as a sleeve 38 in order to receive the stop part 26 therein. In addition, the elastic body 42 is in the form of an elastomer cuff of annular shape which is held in place, for example by vulcanization or gluing, to both the outer surface of the stop part 26 and an inner wall 40 of the sleeve 38. As indicated in FIG. *2a*, the rear end face 44 of the stop part 26 is spaced from a bottom 46 of the sleeve 38 in order to provide a gap 48.

As indicated in FIG. *2a*, the holding part 24 is secured to a bar within the sleeve 38 via a rivet 30 in order to provide rigidity.

As indicated in FIG. 1, the housing 10 of the retractor apparatus is located downstream of a safety brake 34 for braking the projectile 36 to a halt.

During operation, the retractor 28 moves in the direction indicated by the arrow 50 between the front position illustrated and the rear position indicated in broken line 52. During a braking operation via the safety brake 34, the projectile 36 can move up to the rear position of the retractor 28 depending upon the braking action. If the braking action should not be sufficient to bring the projectile 36 to a halt just ahead of the rear position, the projectile 36 will strike on the stop surface 32 of the retractor 28 with the impact energy being absorbed by the elastomer cuff 42. At this time, the stop pat 26 can be axially displaced within the sleeve 38 of the holding part 24 with a corresponding change of the gap 48 (see FIG. *2a*) such that the air cushion in this gap 48 has an additional elastic damping effect.

Referring to FIGS. *3a* to *3c*, wherein like reference characters indicate like parts as above, the retractor may also be formed with a holding part 54 having a channel shaped portion at the end in which a channel shaped elastomer body 56 is disposed. As indicated in FIG. *3c*, the elastomer body 56 is fixed to an outside surface of the stop part 56 and the interior wall of the channel shaped portion of the holding part 54, for example by vulcanization or gluing.

Referring to FIG. 4, wherein like reference characters indicate like parts as above, the retractor 58 may be made in one piece and may be articulated via a bushing 60 about the bolt 22 for securement to the shackle 20. In this case, the bushing 60 may be formed of an elastomer or plastic material. The bushing may also be made of a metal that is different from the material of the retractor, for example of sintered metal.

Referring to FIG. 5, the retractor 62 may also be provided with a plurality of slits or cuts 64 which extend transverse to the direction of motion. As indicated, each slit terminates in a widening 66 of circular shape. In addition, each slit 64 has a flat elastomer body 68 secured therein, for example by clamping, vulcanization or gluing. In this embodiment, the elastically yielding and damping bodies 68 are located close to the stop surface 32 of the retractor 62.

Finally, referring to FIGS. *6a* and *6b*, wherein like reference characters indicate like parts as above, the retractor has a holding part 70 formed with a channel shaped portion at the end which is secured to the stop part 26 via rivets 72. As indicated, a gap 74 is disposed between the rear face of the stop part 26 and an opposed wall of the holding part 70. In this embodiment, the holding part 70 is formed as an elastically yielding and damping body, for example being made of plastic. Alternatively, the material of the holding part 70 may also be made of a metal that is different from the material of the stop part 26. For example, the holding part may be made of aluminum where the stop part is made of steel, for example a structural steel according to DIN 17 100. In this case, the elasticity of the holding part is about three times greater than that of the stop part.

The invention thus provides a retractor apparatus in which an elastically yielding and damping body is used to dissipate the impact forces imposed by a projectile at the stop surface of the retractor. In this regard, the elastically yielding and damping body is provided with a degree of elasticity which is sufficient for absorbing the impact forces imposed on the stop surface when the retractor is in the rear position.

The retractor further dampens any undue vibrations which might have an adverse effect on the cloth being produced in a weaving machine, particularly where the weaving machine is operated at high speed.

What is claimed is:

1. In a weaving machine, the combination comprising a retractor having a stop surface for abutting a weft-inserting projectile;

a retractor lever connected to said retractor for moving said retractor; and at least one elastically yielding and damping body of annular shape between said stop surface and said lever, said body having an elasticity at least three times greater than that of steel.

2. The combination as set forth in claim 1 wherein said retractor includes a stop part having said stop surface thereon and a holding part connected to said stop part in coaxial relation, and wherein said body is connected between said parts to permit coaxial movement between said parts.

3. The combination as set forth in claim 1 which further comprises a bolt connecting said retractor to said lever and said body is a bushing between said bolt and said retractor.

4. The combination as set forth in claim 1 wherein said retractor has a stop part having said stop surface thereon and a holding part secured to said stop part, said holding part forming said body.

5. In a projectile weaving machine, a retractor including a stop surface for abutting a weft-inserting projectile and at least one transverse slit;

means for moving said retractor from a rear position to a forward position to position an abutted projectile in a predetermined position; and at least one elastically yielding and damping body received in said slit between said stop surface and said means, said body having a degree of elasticity sufficient for absorbing impact forces imposed on said stop surface with said retractor in said rear position.

6. The combination as set forth in claim 5 wherein said retractor has a stop part having said stop surface thereon and a holding part secured to said stop part, said holding part forming said body.

7. A retractor apparatus for a weft-inserting projectile in a weaving machine, said apparatus comprising a retractor including a stop surface for abutting a weft-inserting projectile;

means for moving said retractor or from a rear position to a forward position to position an abutted projectile in a predetermined position; and at least one elastically yielding and damping body of annular shape between said stop surface and said means, said body having a degree of elasticity sufficient for absorbing impact forces imposed on said stop surface with said retractor in said rear position.

8. In a weaving machine, the combination comprising a retractor having a stop surface for abutting a weft-inserting projectile;

a retractor lever connected to said retractor for moving said retractor; and at least one elastically yielding and damping body of channel shape between said stop surface and said lever, said body having an elasticity at least three times greater than that of steel.

9. The combination as set forth in claim 8 wherein said retractor includes a stop part having said stop surface thereon and a holding part connected to said stop part in coaxial relation, and wherein said body is connected between said parts to permit coaxial movement between said parts.

* * * * *